US010875342B2

(12) United States Patent
Edwards

(10) Patent No.: US 10,875,342 B2
(45) Date of Patent: Dec. 29, 2020

(54) UV DYE SUBLIMATION DECORATION OF COMPLEX-SHAPED OBJECTS

(71) Applicant: ELECTRONICS FOR IMAGING, INC., Fremont, CA (US)

(72) Inventor: Paul Andrew Edwards, Kalamazoo, MI (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 15/845,988

(22) Filed: Dec. 18, 2017

(65) Prior Publication Data

US 2018/0361769 A1 Dec. 20, 2018

Related U.S. Application Data

(60) Division of application No. 14/732,447, filed on Jun. 5, 2015, now Pat. No. 9,844,963, which is a (Continued)

(51) Int. Cl.
*B41M 5/00* (2006.01)
*B41M 5/035* (2006.01)
(Continued)

(52) U.S. Cl.
CPC ..... *B41M 5/0082* (2013.01); *B41M 5/035* (2013.01); *B41M 5/0358* (2013.01);
(Continued)

(58) Field of Classification Search
CPC .. B41M 5/0358; B41M 5/035; B41M 5/0353; B41M 5/382; B41M 1/40; B41M 5/0082; B41M 5/025; B41M 7/00; B41M 7/0081
See application file for complete search history.

(56) References Cited

U.S. PATENT DOCUMENTS 4,231,742 A 11/1980 Clausen et al.
4,314,814 A * 2/1982 Deroode ..... B29D 12/02 101/470
(Continued)

FOREIGN PATENT DOCUMENTS

CN 1678458 A 10/2005
EP 0883026 12/1998
(Continued)

*Primary Examiner* — Henok D Legesse
(74) *Attorney, Agent, or Firm* — Perkins Coie LLP

(57) ABSTRACT

Various of the disclosed embodiments concern printing systems configured to deposit flexible dye sublimation inks onto flexible transfer materials. Together, the flexible ink and transfer material allow images to be transferred onto complex-shaped, i.e. non-planar, surfaces of a substrate. The flexible ink may be, for example, a thermoformable UV dye sublimation ink or a superflexible UV dye sublimation ink. In order to transfer an image onto the substrate, the transfer material is pressed onto the surface of the substrate. The substrate, transfer material, or both are heated to a temperature sufficient to cause the ink to sublimate. During the sublimation process, dye is able to permeate the substrate and form a transferred image. The flexible ink formulation may also include a soluble or solvent-sensitive component. In such embodiments, a solvent can be jetted onto the substrate and/or transfer material to remove residual ink.

21 Claims, 7 Drawing Sheets

Related U.S. Application Data continuation-in-part of application No. 14/683,846, filed on Apr. 10, 2015, now Pat. No. 9,789,706.

(51) Int. Cl.
*B41M 7/00* (2006.01)
*B41M 5/025* (2006.01)

(52) U.S. Cl.
CPC ..... *B41M 5/025* (2013.01); *B41M 5/0353* (2013.01); *B41M 7/00* (2013.01); *B41M 7/0081* (2013.01)

(56) References Cited

U.S. PATENT DOCUMENTS

| | | | | |
|---|---|---|---|---|
| 6,254,216 | B1 | 7/2001 | Arway et al. | |
| 6,726,317 | B2 | 4/2004 | Codos | |
| 6,846,851 | B2 | 1/2005 | Nakhmanovich et al. | |
| 7,435,264 | B2 | 10/2008 | Kiff | |
| 8,337,007 | B2 | 12/2012 | Wang et al. | |
| 8,876,979 | B2 | 11/2014 | Uptergrove et al. | |
| 2002/0044188 | A1 | 4/2002 | Codos et al. | |
| 2005/0100705 | A1 | 5/2005 | Kiff | |
| 2007/0054211 | A1 | 3/2007 | Hsieh et al. | |
| 2009/0317555 | A1* | 12/2009 | Hori | B41J 2/0057 427/428.06 |
| 2010/0220169 | A1* | 9/2010 | Howell | B41F 16/00 347/186 |
| 2010/0304040 | A1 | 12/2010 | Chretien et al. | |
| 2012/0038723 | A1 | 2/2012 | Wang et al. | |
| 2012/0194622 | A1 | 8/2012 | Iraqi et al. | |
| 2013/0202858 | A1 | 8/2013 | Shimohara et al. | |
| 2013/0236643 | A1* | 9/2013 | Coghlan | B41M 3/008 427/258 |
| 2014/0300676 | A1* | 10/2014 | Miller | B41F 17/38 347/110 |
| 2016/0002848 | A1 | 1/2016 | Roberts | |
| 2016/0297224 | A1 | 10/2016 | Edwards | |
| 2016/0297225 | A1 | 10/2016 | Edwards | |

FOREIGN PATENT DOCUMENTS

| | | | |
|---|---|---|---|
| JP | 2006144180 | A | 6/2006 |
| JP | 4834979 | B2 | 10/2011 |

* cited by examiner

UV DYE SUBLIMATION DECORATION OF COMPLEX-SHAPED OBJECTS

CROSS-REFERENCE TO RELATED APPLICATIONS

This application is a division of U.S. patent application Ser. No. 14/732,447, filed on Jun. 5, 2015, now U.S. Pat. No. 9,844,963, which is a continuation-in-part of U.S. patent application Ser. No. 14/683,846, filed on Apr. 10, 2015, now U.S. Pat. No. 9,789,706, each of which is incorporated by reference herein.

RELATED FIELD

Various embodiments relate generally to dye sublimation inks. More specifically, various embodiments relate to printing systems, methods, and dye sublimation ink formulations for transferring images onto complex-shaped objects.

BACKGROUND

Dye sublimation inks have long been used for printing on polyester-based materials and objects. Conventionally, sublimation printing processes have used thermal printers and dye transfer paper and have employed analog printing methods. The dye sublimation inks include a pigment suspended in a liquid solvent, such as water. Inkjet inks and inkjet printers have also recently been used for sublimation printing processes.

The market for digital textile printing has grown substantially in recent years. This has led to increased usage of and interest in solvent-based, e.g. water-based, dye sublimation inks. Outside of textile applications, other polyester-based materials are also decorated using dye sublimation technology. Examples include films, containers, packaging, and materials having a polyester coating, such as wood or metal.

Two types of printing processes can be used in sublimation printing. Direct printing requires that ink is jetted directly onto a substrate, cured, and then thermally treated such that the dye diffuses from the ink into the substrate. Indirect printing requires that ink is printed onto heat-resistant transfer paper or another transfer material and cured, e.g. via UV radiation. The transfer paper is placed over a substrate and heat is applied that causes the dye to transfer to the substrate from the transfer paper and form an image.

Indirect printing is both more costly and more complex due to the presence of the transfer paper. Moreover, the transferring process can be materially hindered if the image is not printed onto a flat substrate.

Conventionally, both direct and indirect printing have been carried out only on flat substrates. Because print quality of direct printing relies on accuracy of ink drop placement, the distance between the printer head and the substrate is critical. The distance, which is generally a few millimeters or less, must be kept constant or nearly constant to limit the effects of velocity variability, airflow, etc., on drop placement. Similar issues plague indirect printing. It is often difficult, if not impossible, to conform transfer paper to complex shapes.

SUMMARY

Introduced herein are systems and methods for sublimation printing on complex-shaped surfaces. Various printing systems described herein print an image onto a flexible transfer material using a flexible ink formulation. A flexible transfer material, such as a rubber former or thermoformable material, can be used to transfer images to a complex-shaped, i.e. non-planar, substrate. Oftentimes, the image is pre-distorted to take into account the final shape of the transfer material after sublimation. The flexible ink may be, for example, a thermoformable or superflexible ultraviolet (UV) dye sublimation ink.

In some embodiments, the printing systems described herein cure the image jetted onto the transfer material before the image is transferred to the substrate. Consequently, the printing systems may include a light source configured to cure some or all of the ink deposited on the transfer material by a printer head. The light source can be configured to emit UV radiation of subtype V, subtype A, subtype B, subtype C, or some combination thereof.

The transfer material, including the image, can then be formed to fit the substrate and pressed onto the surface of the substrate. In some embodiments, a mold or heat-resistant material, e.g. sand, is used to apply pressure to the transfer material. The substrate typically includes polyester or has a polyester-based coating/spray applied prior to printing. Once the transfer material is pressed onto the substrate, heat is applied to the substrate, the transfer material, or both that is sufficient to cause the ink to sublimate. Sublimation causes at least some of the dye within the ink to permeate the substrate and form a finalized image.

In some embodiments, the flexible ink used to create the image includes a soluble or solvent-sensitive component that allows residual ink to be easily removed, e.g. by a washing process, following sublimation. For example, a solvent may be jetted onto the substrate and/or transfer material that substantially removes residual ink that did not permeate the substrate during sublimation.

DETAILED DESCRIPTION

Various embodiments are described herein that relate to printing on complex-shaped objects. More specifically, various embodiments relate to printing systems and methods for transferring images to complex-shaped substrates using flexible dye sublimation ink technology and flexible former materials.

Figure 1:
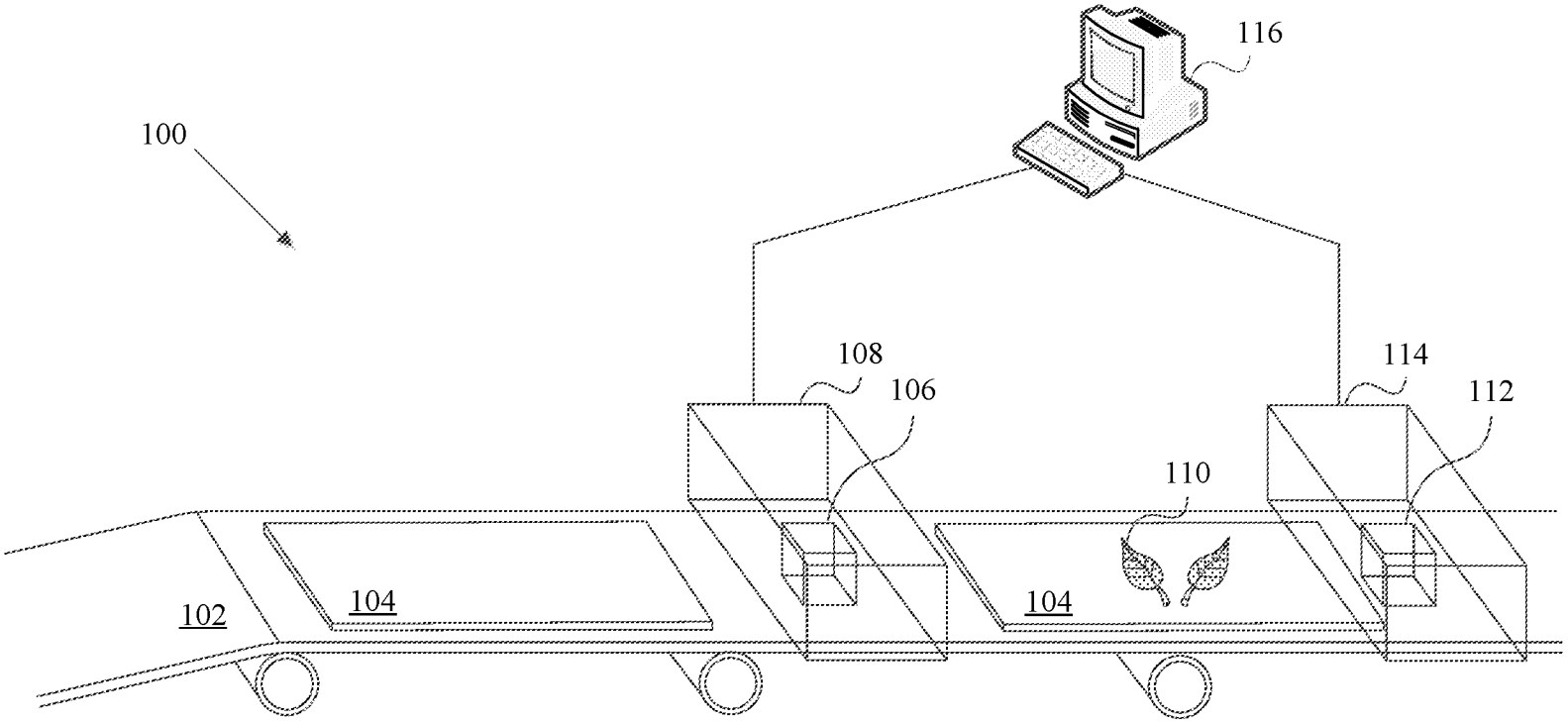
FIG. 1 is a diagrammatic perspective view of a printing system according to various embodiments of the disclosure.

FIG. 1 is a diagrammatic perspective view of a printing system 100 according to various embodiments of the disclosure. The printing system 100 includes a printer head 106, at least one light source 112, and a transfer belt 102. Embodiments may include various combinations of these and other components, e.g. a dryer. For example, the light source 112 may be present in some embodiments, but not in others. As another example, a dryer may be included if the image 110 will not be quickly transferred to a substrate. While the printing system 100 of FIG. 1 includes a transfer belt 102, other means for conveying and/or retaining transfer material 104 can also be used, such as a rotating platform or stationary bed.

The printer head 106 is configured to deposit ink onto a transfer material 104 in the form of an image 110. The transfer material 104, which may also be referred to as a former material, is flexible, which allows the image 110 to be transferred to complex-shaped substrates. For example, the transfer material 104 may be a rubber former, a thermoformable material, etc. In some embodiments, the printer head 106 is an inkjet printer head that jets ink onto the transfer material 104 using, for example, piezoelectric nozzles. Thermal print heads are generally avoided in an effort to avoid premature sublimation of the ink. In some embodiments, the ink is a solid energy, e.g. UV, curable ink. However, other inks may also be used, such as water-based energy curable inks or solvent-based energy curable inks. The ink can be deposited in different forms, such as ink droplets and colored polyester ribbons.

In some embodiments, one or more light sources 112 cure some or all of the ink deposited on the transfer material 104 by emitting UV radiation. The light source(s) 112 may be, for example, a UV fluorescent bulb, a UV light emitting diode (LED), a low pressure, e.g. mercury (Hg), bulb, or an excited dimer (excimer) lamp and/or laser. Various combinations of these light sources could be used. For example, a printing system 100 may include a low-pressure Hg lamp and a UV LED. As will be discussed below with respect to FIG. 2, the light source 112 may be configured to emit UV radiation of a particular subtype.

The printer head 106 and light source 112 are illustrated as being directly adjacent to one another, i.e. neighboring without any intervening components. However, additional components that assist in printing, curing, etc., may also be present. For example, multiple distinct light sources 112 may be positioned behind the printer head 106. FIG. 1 illustrates one possible order in which components may be arranged in order to print an image 110 onto the former material 104. Other embodiments are considered in which additional components are placed before, between, or after the illustrated components, etc.

In some embodiments, one or more of the aforementioned components are housed within one or more carriages. For example, the printer head 106 can be housed within a printing carriage 108, the light source 112 can be housed within a curing carriage 114, etc. In addition to protecting the components from damage, the carriages may also serve other benefits. For example, curing carriage 114 can limit what portion(s) of the transfer material 104 and image 110 are exposed during the curing process. The printing system 100 may comprise pulleys, motors, rails, and/or any combination of mechanical or electrical technologies that enable the carriages to travel along the transfer belt 102, i.e. with respect to the transfer material 104. In alternative embodiments, the carriages can be fixedly attached to a rail or base of the printing system 100. In these embodiments, the transfer material 104 can be moved in relation to the printer head 106, light source 112, etc., such that ink can be deposited on the transfer material 104.

Figure 7:
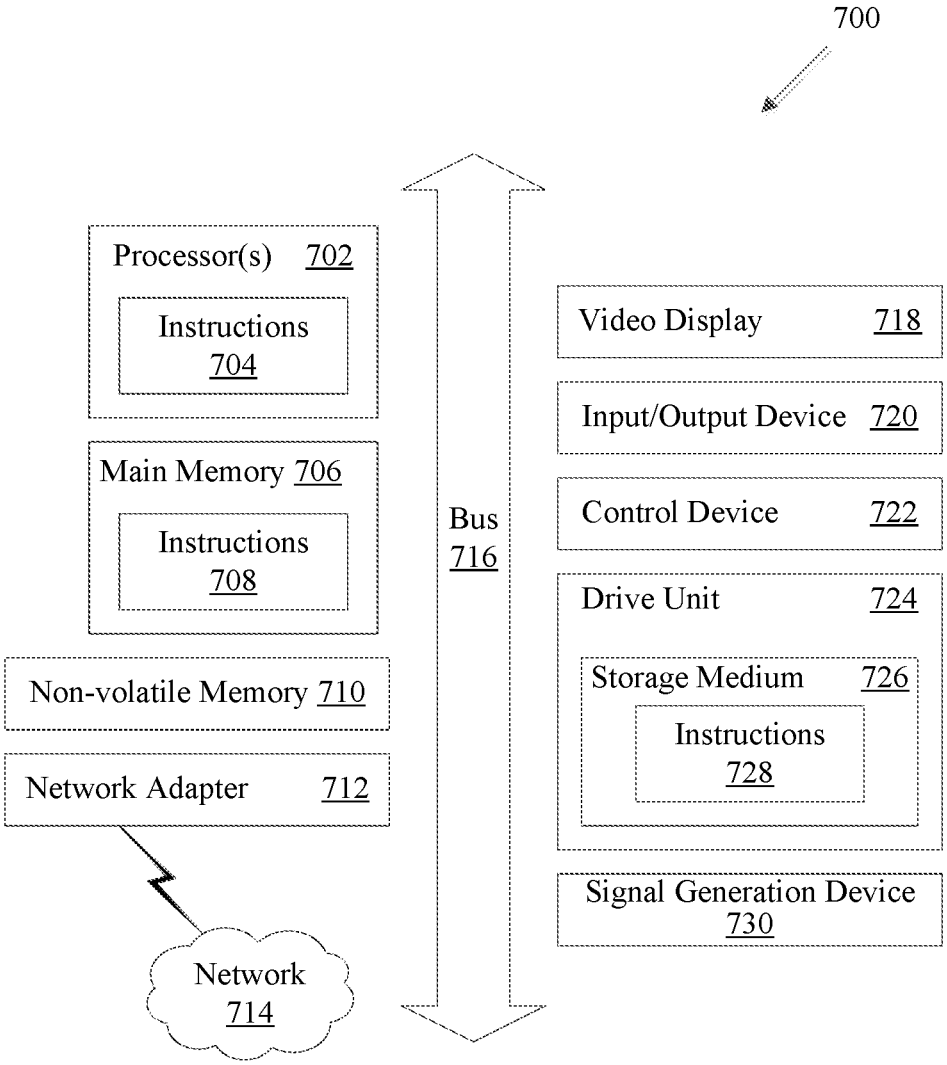
FIG. 7 is a block diagram illustrating an example of a computer system in which at least some of the operations described herein can be implemented.

In various embodiments, some or all of the components are controlled by a computer system 116, e.g. computer system 700 of FIG. 7. The computer system 116 can allow a user to input printing instructions and information, modify print settings, e.g. by changing cure settings, alter the printing process, etc.

Figure 2:
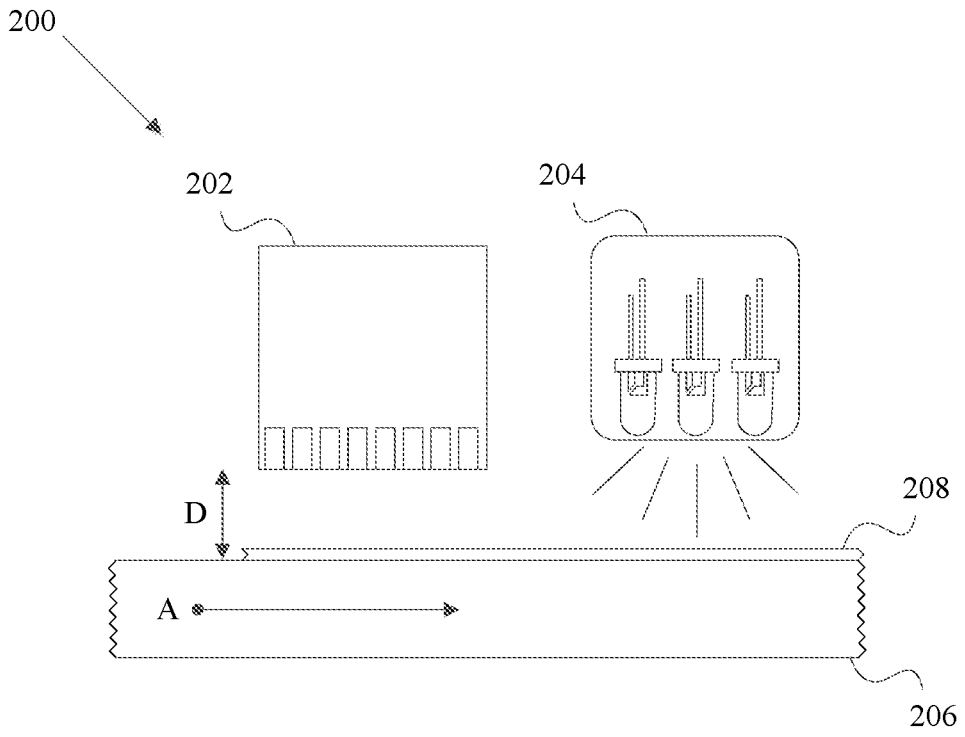
FIG. 2 is a side view of a printing system, including a printer head and a light source, in accordance with various embodiments.

FIG. 2 is a side view of a printing system 200, including a printer head 202 and a light source 204, in accordance with various embodiments. While a single-pass configuration is illustrated by FIG. 2, other embodiments may employ multi-pass, i.e. scan, configurations. Similarly, embodiments can be modified for various printers, e.g. flatbed printer, drum printer, lane printer. For example, a flatbed printer may include a stable bed and a traversing printer head, stable printer head and a traversing bed, etc.

The printer head 202 can include distinct ink/color drums, e.g. CMYK, or colored polyester ribbons that are deposited on the surface of a transfer material 206. Path A represents the media feed direction, e.g. the direction in which the transfer material 206 travels during the printing process. Path D represents the distance between the printer head 202 and the surface of the transfer material 206.

As described above, both direct and indirect printing have conventionally been carried out only on flat surfaces. The printing systems and methods described herein, however, allow images to be printed on complex-shaped, i.e. non-planar, surfaces by depositing ink directly onto a transfer material 206 and then transferring the ink to a substrate. When printing directly onto a surface, print quality relies on accuracy of ink drop placement. Therefore, maintaining a constant or nearly constant distance between the printer head 202 and the flat surface of the transfer material 206 is necessary. Airflow, velocity variability, etc., can affect drop placement even when the change in distance is small, e.g. a few millimeters.

In some embodiments, a light source 204 cures some or all of the ink 208 deposited on the transfer material 206 by the printer head 202. The light source 204 may be configured to emit wavelengths of UV electromagnetic radiation of subtype V (UVV), subtype A (UVA), subtype B (UVB), subtype C (UVC), or any combination thereof. Generally, UVV wavelengths are those wavelengths measured between 395 nanometers (nm) and 445 nm, UVA wavelengths measure between 315 nm and 395 nm, UVB wavelengths measure between 280 nm and 315 nm, and UVC wavelengths measure between 100 nm and 280 nm. However, one skilled in the art will recognize these ranges are somewhat adjustable. For example, some embodiments may characterize wavelengths of 285 nm as UVC.

The light source 204 may be, for example, a fluorescent bulb, a light emitting diode (LED), a low pressure, e.g. mercury (Hg), bulb, or an excited dimer (excimer) lamp/laser. Combinations of different light sources could be used in some embodiments. Generally, the light source 204 is selected to ensure that the curing temperature does not exceed the temperature at which the ink 208 begins to sublime. For example, light source 204 of FIG. 2 is a UV LED lamp that generates low heat output and can be used for a wider range of former types. UV LED lamps are associated with lower power consumption, longer lifetimes, and more predictable power output.

Other curing processes may also be used, such as epoxy (resin) chemistries, flash curing, and electron beam technology. One skilled in the art will appreciate that many different curing processes could be adopted that utilize specific timeframes, intensities, rates, etc. The intensity may increase or decrease linearly or non-linearly, e.g. exponentially, logarithmically. In some embodiments, the intensity may be altered using a variable resistor or alternatively by applying a pulse-width-modulated (PWM) signal to the diodes in the case of an LED light source.

Figure 3A:
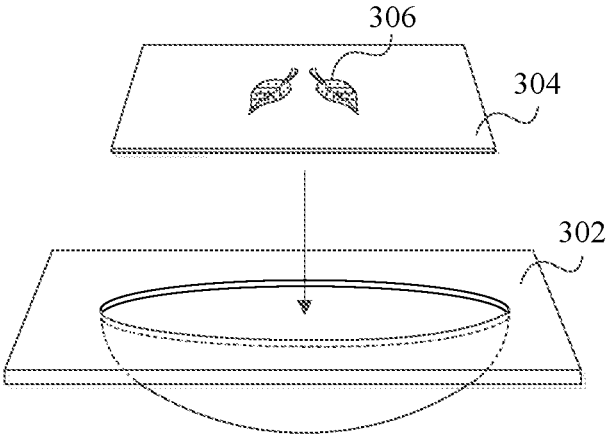
FIGS. 3A-C are perspective views of an image being transferred from a transfer material to a substrate according to some embodiments.
Figure 3B:
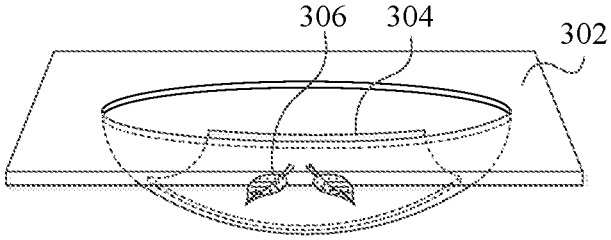
Figure 3C:
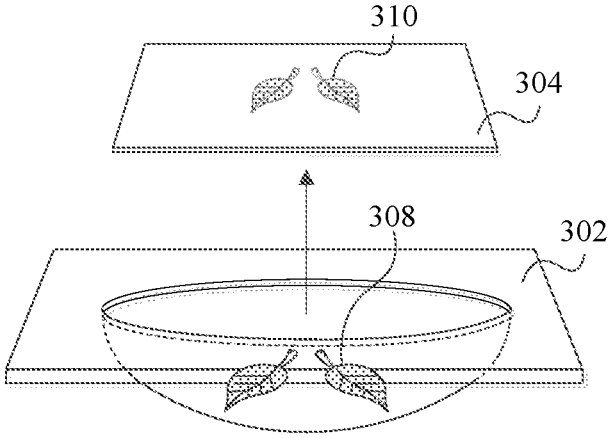

FIGS. 3A-C are perspective views of an image 306 being transferred from a transfer material 304 to a substrate 302 according to some embodiments. The surface of the substrate 302 is "complex-shaped." More specifically, the surface is non-planar and has three-dimensional characteristics. For example, the substrate 302 of FIGS. 3A-C is a curved sink unit. Generally, the surfaces of the transfer material 304 and the substrate 302 are clean, i.e. free or substantially free of unwanted particles, prior to transferring. The embodiments described herein are particularly valuable when printing onto complex-shaped substrates that have low absorbency, are soft, and/or have some surface structure, features, or indentations. That is, when conventional sublimation methods are impossible or impractical. However, the systems and methods described herein could be used to improve print quality for other printing processes and substrates, e.g. textiles, as well. In some embodiments, the substrate 302 is polyester, a polyester composite, or a polyester-coated material, such as an agglomerated stone material that includes marble, quartz, etc. "Agglomerated stone" is a subset of composite material that is also referred to as engineered stone. The dye used to form the image 306 could also be designed and formulated to work with various hydrophobic polymers, such as nylon and nylon blends.

As shown in FIG. 3B, the transfer material 304 is pressed into or placed over the substrate 302. In some instances, a mold or some other heat-resistant material, e.g. sand, is used to position the transfer material 304 over the substrate 302. Oftentimes, the image 306 is pre-distorted to take into account the final shape of the transfer material 304 when pressed onto the substrate 302.

Sublimation may require the transfer material 304, substrate 302, or both be heated up. As the sublimation process begins, some of the dye or pigment within the ink sublimes, or is converted into a gas, and permeates/diffuses into the substrate 302. The sublimed dye re-solidifies within the substrate 302, thereby forming the intended or final image 308. In various embodiments, flexible dye formulations are used that allow the image 306 to expand up to 500% of its original size during the sublimation process. Consequently, the final image 308 may not be the same size as the image 306 initially printed on the transfer material 304.

As shown in FIG. 3C, the transfer material 304 can be removed from the surface of the substrate 302 once the final image 308 is formed. Residual ink 310 that did not permeate the substrate 302 may be removed from the transfer material 304, the substrate 302, or both by a washing process. In some embodiments, image quality is improved by identifying an optimal sublimation temperature, an optimal sublimation duration, applying pressure to the transfer material 304 during sublimation, etc.

Figure 4A:
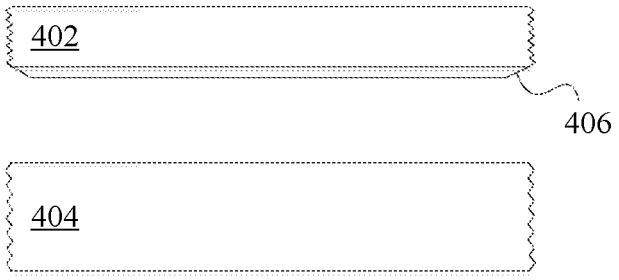
FIGS. 4A-C are side views of deposited ink during various stages of a sublimation printing process in accordance with some embodiments.
Figure 4B:
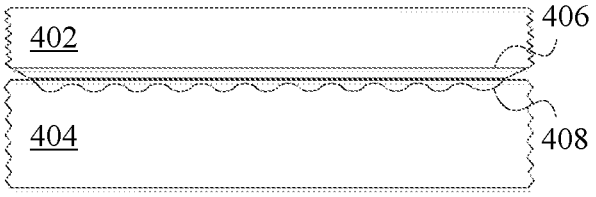
Figure 4C:
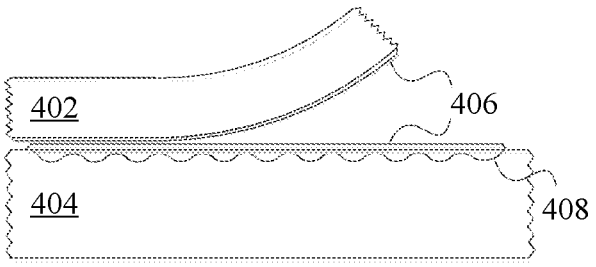

FIGS. 4A-C are side views of deposited ink 406 during various stages of a sublimation printing process in accordance with some embodiments. As shown in FIG. 1, ink 406 is initially deposited by a printer head on the surface of a transfer material 402 that is used to accurately transfer an image to a substrate 404. The transfer material 402 can be, for example, a rubber former or thermoformable material. The ink 406 contains dye in a dispersed form that is not soluble within the ink 406. The ink 406, i.e. image, is pressed onto the surface of the substrate 404, as shown in FIG. 4B, and the transfer material 402, substrate 404, or both are heated, which causes at least some of the dye in the ink 406 to sublimate. During sublimation, dye is able to leave the ink 406 and permeate the substrate 404, where it re-solidifies into a final image 408. Once within the substrate 404, the dye becomes entirely or substantially insoluble. Pressure may also be applied to improve the accuracy and/or effectiveness with which the image is transferred to the substrate 404.

When effective ink formulations are designed, a number of factors are considered, including flexibility, cross-linked density, ability to adhere to the substrate, and ink tack. Other factors can include the curing process utilized, substrate type, former type, the application(s) for which the substrate is to be used, etc. When printing onto complex-shaped substrates 404, it is important for the ink formulation(s) to be flexible. Flexibility allows the ink 406, i.e. image, to change shape without cracking, separating from the transfer material 402, or distorting at the same rate as the transfer material 402. Depending on the shape of the substrate 404, the image may need to stretch from 100% to 500% of its original size.

Various embodiments described herein are especially useful in combination with superflexible UV dye sublimation inks and thermoformable UV dye sublimation inks, such as are described in co-owned U.S. Pat. Nos. 7,427,317, 7,431,759, and 7,662,224, each of which is incorporated by reference herein. However, other ink formulations and technologies can also be used. Images printed using superflexible UV dye sublimation inks are known to extend up to 200% of their original size when heat is applied. Thermoformable UV dye sublimation inks, meanwhile, allow images to extend more than 400% of their original size when heat is applied.

Standard UV inks are typically formulated to have good adhesion and surface cure characteristics. This is done by modifying the cross-linked density and altering what monomers present that adhere to the transfer material 402 and/or substrate 404. However, the ink formulations used by the printing systems and methods described herein need not be designed to exhibit great adhesion or rub resistance. These inks are meant to have a relatively short lifetime before being transferred to the substrate 404.

The transfer material 402 can be removed from the surface of the substrate 404 once sublimation has completed, as shown in FIG. 4C. Unused residual ink 406 will generally still be on the surface of the transfer material 402, the substrate 404, or both. If the ink includes a soluble component, the residual ink 46 can be removed by a washing process, as described in co-owned U.S. patent application Ser. No. 14/683,846, which is incorporated by reference herein. Soluble ink formulations may also allow the transfer material 402 to be washed and reused in subsequent image transfers.

Figure 5:
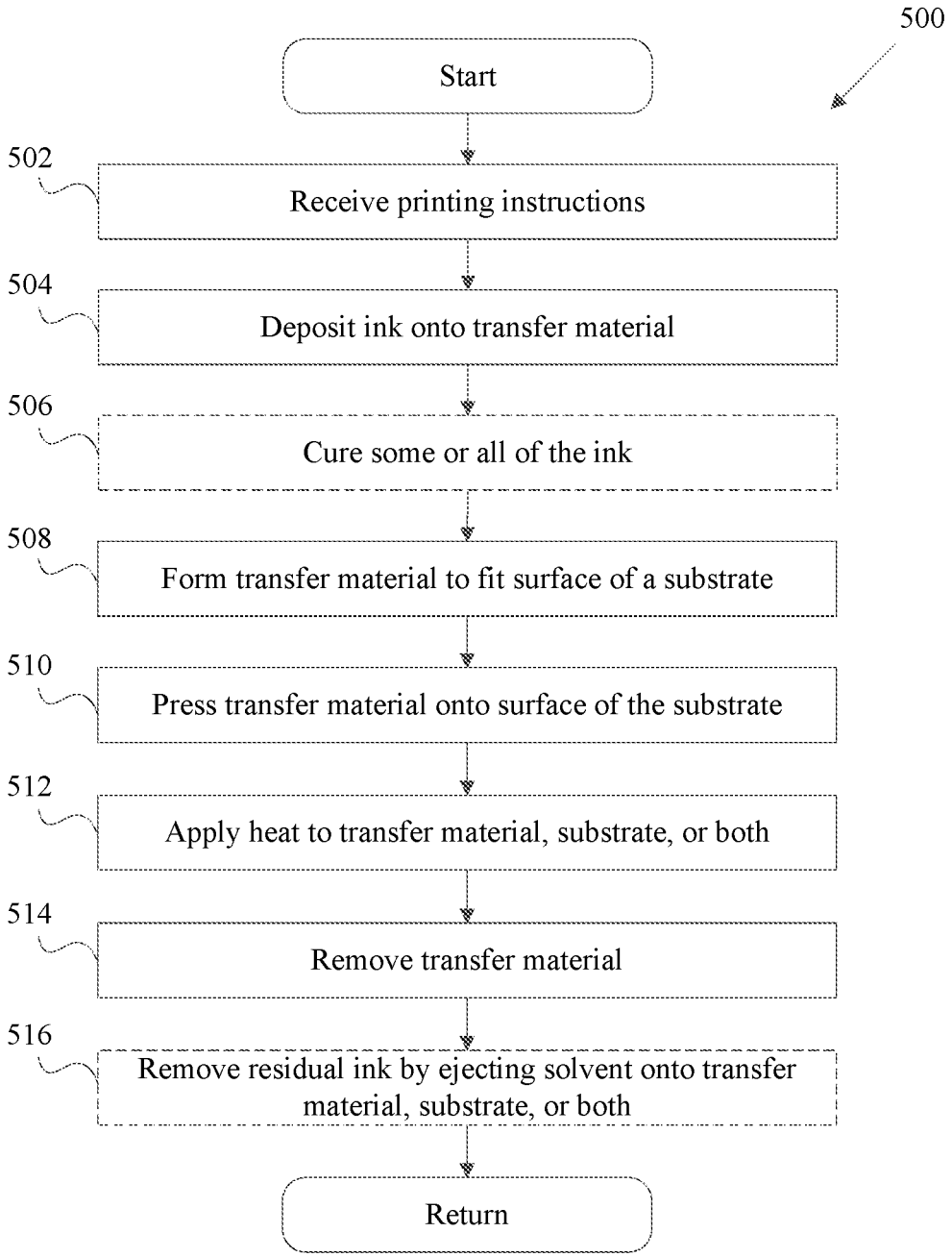
FIG. 5 is a flow diagram illustrating a process for printing onto complex-shaped surfaces using flexible ink technology in accordance with various embodiments.

FIG. 5 is a flow diagram illustrating a process 500 for printing onto complex-shaped surfaces using flexible ink technology in accordance with various embodiments. At block 502, a user or system provides printing instructions to a printing system, e.g. printing system 100 of FIG. 1. In some embodiments, the user inputs the instructions by interacting with a computer system, e.g. computer system 116 of FIG. 1. The computer system communicates the instructions through a wired connection, e.g. universal serial bus (USB) connection, or a wireless connection, e.g. local Wi-Fi network, Bluetooth peer to peer connection, an Internet service provider (ISP) coupled to the local Wi-Fi network via a router, or any combination thereof. Instructions can be stored locally, e.g. within a storage, or received from a remote database.

At block 504, the printing system begins printing an image by depositing ink on the surface of a transfer material, e.g. thermoformable material, according to the printing instructions. The transfer material may be, for example, a thermoformable material such as an amorphous polymer. Formable transfer materials and substrates can include, for example, acrylonitrile butadiene styrene (ABS), polystyrene, polycarbonate, polyethylene, polypropylene, acrylics, e.g. casts and films, polyvinyl chloride (PVC), and vinyl copolymers. The instructions, meanwhile, can indicate where ink is to be deposited, what ink(s), transfer material (s), or substrate(s) are to be used, etc. In some embodiments, the printing system cures at least some of the ink deposited on the transfer material, as shown at block 506. For example, a UV LED light source can be used to cure thermoformable or superflexible UV dye sublimation ink. The UV LED light source can emit wavelengths within a certain range, e.g. UVC wavelengths. The range and/or UV subtype emitted by the light source may be selected to more effectively cure particular ink formulations used by the printing system. The ink is typically cured immediately or shortly after being deposited on the transfer material.

At block 508, the transfer material is formed to fit the complex-shaped surface of a substrate and, at block 510, the transfer material is pressed onto the complex-shaped surface. At block 512, the ink is heated to a temperature that is sufficient to cause some or all of the dye component within the ink to sublime and permeate the surface of the substrate. The transfer material, substrate, or both may be heated by the printing system or a distinct heating element. The required temperature may vary depending on the ink formulation, transfer material type, substrate type, etc. The temperature must be high enough to cause the ink to sublimate, but not so high as to damage the substrate or transfer material. At block 514, the transfer material is removed once sublimation has finished.

In some embodiments, residual ink is removed by jetting a solvent onto the surface of the transfer material, the substrate, or both, as shown at block 516. The residual ink is any ink that did not permeate the substrate, i.e. remains on the surface of the substrate or transfer material following sublimation. In such embodiments, the ink is soluble or solvent-sensitive, which allows excess ink to be easily removed by applying a solvent, such as water. Although the residual ink, which contains a depleted level of dye, is designed to dissolve during the washing process, the sublimed dye is not affected. Once transferred to the substrate, the sublimed dye is substantially insoluble with respect to the solvent used for washing.

Figure 6:
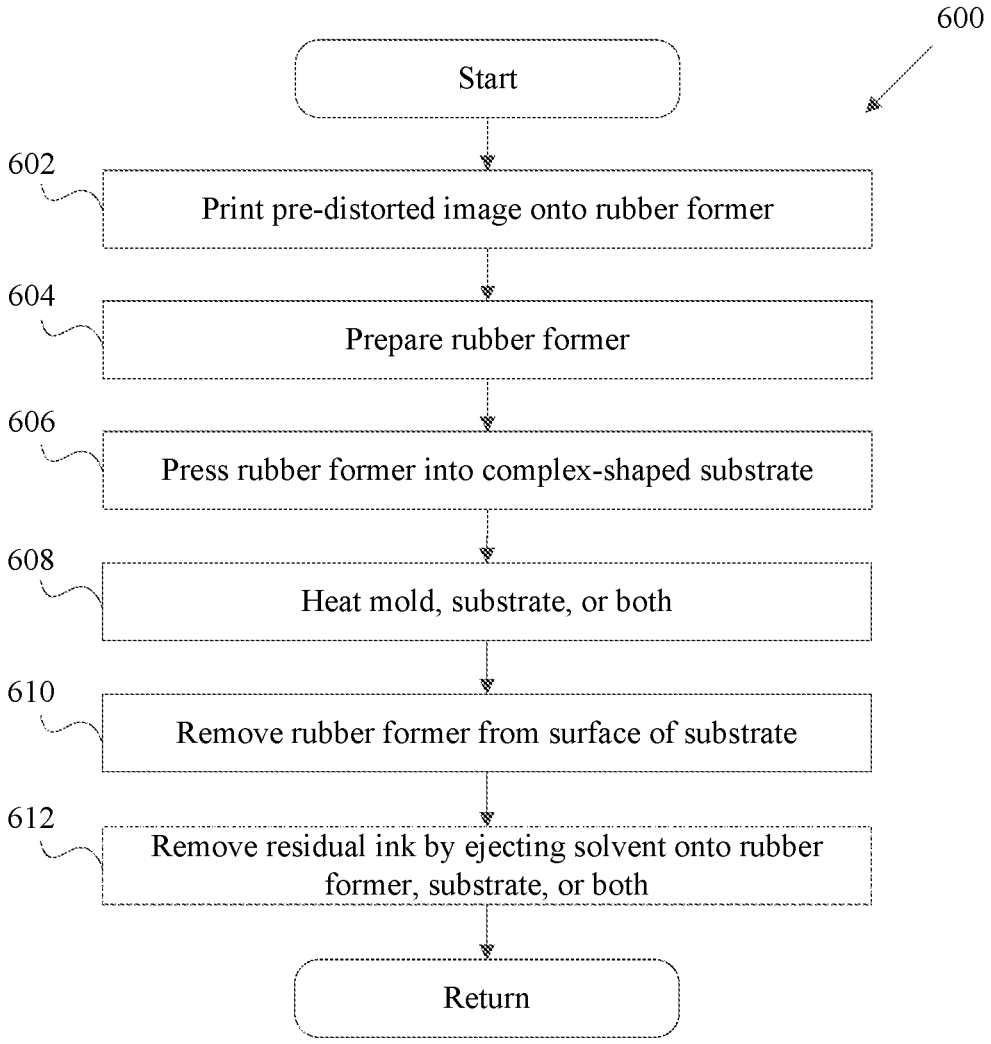
FIG. 6 is a flow diagram illustrating another process for printing onto complex-shaped surfaces using flexible ink technology in accordance with various embodiments.

FIG. 6 is a flow diagram illustrating another process 600 for printing onto complex-shaped surfaces using flexible ink technology in accordance with various embodiments. At block 602, a pre-distorted image is printed onto a rubber former according to a set of printing instructions. The image is distorted to account for the final shape of the rubber former when pressed onto a complex-shaped substrate.

At block 604, the rubber former, including the pre-distorted image, is prepared for sublimation and, at block 606, the rubber former is pressed onto the surface of the complex-shaped substrate. Typically, pressure is applied using a mold or some heat-resistant material, such as sand. At block 608, some combination of the substrate, rubber former, and mold/heat-resistant material are heated to a temperature sufficient to cause the ink to sublimate. Specific temperatures and/or periods of time may be used that improve the print quality of the resulting image.

At block 610, the rubber former is removed from the surface of the substrate. The mold and/or heat-resistant material is also removed if used to apply pressure or maintain the position of the rubber former. In some instances, residual ink will remain on the surfaces of the substrate and rubber former. If the ink formulation includes a soluble component, the residual ink can be removed by ejecting a solvent, e.g. water, onto the surfaces of the substrate and rubber former, as shown at block 612. If the ink formulations is sufficiently soluble, the rubber former can be reused for subsequent image transfers.

FIG. 7 is a block diagram illustrating an example of a computer system 700 in which at least some of the operations described herein can be implemented. The computer system 700 may include one or more central processing units ("processors") 702, main memory 706, non-volatile memory 710, network adapter 712, e.g. network interfaces, video display 718, input/output devices 720, control device 722, e.g. keyboard and pointing devices, drive unit 724 including a storage medium 726, and signal generation device 730 that are communicatively connected to a bus 716.

The bus 716 is illustrated as an abstraction that represents any one or more separate physical buses, point to point connections, or both connected by appropriate bridges, adapters, or controllers. The bus 716, therefore, can include, for example, a system bus, a Peripheral Component Interconnect (PCI) bus or PCI-Express bus, a HyperTransport or industry standard architecture (ISA) bus, a small computer system interface (SCSI) bus, a USB, IIC (I2C) bus, or an Institute of Electrical and Electronics Engineers (IEEE) standard 1394 bus, also called "Firewire."

The computer system 700 may be a server computer, a client computer, a personal computer (PC), a user device, a tablet PC, a laptop computer, a personal digital assistant (PDA), a cellular telephone, an Android, an iPhone, an iPad, a Blackberry, a processor, a telephone, a web appliance, a network router, switch or bridge, a console, a hand-held console, a (hand-held) gaming device, a music player, any portable/mobile hand-held device, wearable device, or any machine capable of executing a set of instructions, sequential or otherwise, that specify actions to be taken by that machine.

The main memory 706, non-volatile memory 710, and storage medium 726 are computer-readable storage media that may store instructions 704, 708, 728 that implement at least portions of various embodiments. The instructions 704, 708, 728 can be implemented as software and/or firmware to program processor(s) 702 to carry out the actions described above.

The network adapter 712 enables the computer system 700 to mediate data in a network 714 with an entity that is external to the computer device 700, through any known and/or convenient communications protocol. The network adapter 712 can include a network adaptor card, wireless network interface card, router, access point, wireless router, switch, multilayer switch, protocol converter, gateway, bridge, bridge router, hub, digital media receiver, and/or repeater.

The techniques introduced here can be implemented by, for example, programmable circuitry, e.g. one or more processors, programmed with software and/or firmware, entirely in special-purpose hardwired, i.e. non-programmable, circuitry, or in a combination of such forms. Special-purpose circuitry may be in the form of, for example, one or more application-specific integrated circuits (ASICs), programmable logic devices (PLDs), field-programmable gate arrays (FPGAs), etc.

The language used in the Detailed Description has been principally selected for readability and instructional purposes, and it may not have been selected to delineate or circumscribe the inventive subject matter. It is therefore intended that the scope of the technology be limited not by the Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. A method for printing on complex-shaped objects, the method comprising:

depositing sublimation ink that comprises a dye component onto a rubber former to form an image;

pressing the rubber former onto a non-planar surface of a complex-shaped substrate onto which the image is to be transferred, wherein the image is pre-distorted to account for deformation of the rubber former;

heating the sublimation ink to a temperature that is sufficient to cause at least some of the dye component to sublime, permeate the non-planar surface, and form a finalized image within the complex-shaped substrate; and removing the rubber former from the non-planar surface of the complex-shaped substrate so that the rubber former naturally regains its original shape.

2. The method of claim 1, wherein the complex-shaped substrate is partially or entirely composed of polyester.

3. The method of claim 1, wherein said heating is accomplished by heating the rubber former, the complex-shaped substrate, or both for a specific period of time.

4. The method of claim 1, wherein the rubber former is pressed against the non-planar surface by a mold or a heat-resistant material.

5. The method of claim 4, wherein pressure applied by the mold or the heat-resistant material causes the rubber former to deform and the image to expand.

6. The method of claim 4, wherein the heat-resistant material is sand.

7. The method of claim 1, wherein the sublimation ink further comprises a soluble component.

8. The method of claim 7, further comprising:

ejecting a solvent onto the rubber former and the non-planar surface of the complex-shaped substrate after the rubber former has been removed, wherein the solvent causes the soluble component to dissolve, thereby substantially removing residual sublimation ink not used to form the finalized image.

9. A method comprising:

depositing sublimation ink that comprises (i) a dye component and (ii) a soluble component onto a first surface of a rubber former to form a first image;

pressing the first surface of the rubber former onto a non-planar surface of a substrate;

heating the sublimation ink to a temperature that is sufficient to cause at least some of the dye component to sublime, permeate the non-planar surface of the substrate, and form a second image within the substrate;

removing the rubber former from the non-planar surface of the substrate;

ejecting a first solvent onto the non-planar surface of the substrate to cause dissolution of residual sublimation ink remaining on the non-planar surface of the substrate; and ejecting a second solvent onto the first surface of the rubber former to cause dissolution of residual sublimation ink remaining on the first surface of the rubber former so that the rubber former is reusable to transfer another image into another substrate.

10. The method of claim 9, wherein said pressing comprises:

applying pressure to a second surface of the rubber former with a mold that substantially complements the non-planar surface of the substrate.

11. The method of claim 9, wherein said pressing comprises:

applying pressure to a second surface of the rubber former with sand.

12. The method of claim 9, wherein the temperature is based on formulation of the sublimation ink, composition of the rubber former, composition of the substrate, or any combination thereof.

13. The method of claim 9, wherein the first image is pre-distorted to account for deformation of the rubber former when pressed against the non-planar surface of the substrate.

14. The method of claim 9, wherein the first image is pre-distorted to account for expansion of the sublimation ink when exposed to heat.

15. The method of claim 14, wherein the second image represents an expansion of the first image by at least 200%.

16. The method of claim 9, wherein the sublimation ink further includes an ultraviolet-curable (UV-curable) component.

17. The method of claim 16, further comprising:

after the sublimation ink has been deposited onto the first surface of the rubber former, curing at least some of the sublimation ink by exposing the sublimation ink to UV radiation.

18. The method of claim 9, wherein the first and second solvents are the same solvent.

19. A method comprising:

depositing sublimation ink that includes (i) a dye component and (ii) a soluble component onto a surface of a rubber former;

pressing the surface of the rubber former onto a non-planar surface of a first substrate, thereby causing deformation of the rubber former;

heating the sublimation ink to a first temperature that is sufficient to cause at least some of the dye component to sublime, permeate the non-planar surface of the first substrate, and form a first image within the first substrate; and removing the rubber former from the non-planar surface of the first substrate so that the rubber former naturally regains its original shape.

20. The method of claim 19, further comprising:

ejecting a solvent onto the surface of the rubber former to cause dissolution of residual sublimation ink remaining on the surface of the rubber former;

depositing sublimation ink onto the surface of the rubber former;

pressing the surface of the rubber former onto a non-planar surface of a second substrate;

heating the sublimation ink to a second temperature that is sufficient to cause at least some of the dye component to sublime, permeate the non-planar surface of the second substrate, and form a second image within the second substrate; and removing the rubber former from the non-planar surface of the second substrate.

21. The method of claim 20, wherein the first and second temperatures are different temperatures.

* * * * *